US007661250B2

(12) United States Patent
Vandevoorde et al.

(10) Patent No.: US 7,661,250 B2
(45) Date of Patent: Feb. 16, 2010

(54) ASSEMBLE FOR POSITIONING SLEEVES ON PRODUCTS SUCH AS BOTTLES

(76) Inventors: Jean-Claude Vandevoorde, 39 route d'Ailly, Montdidier (FR) F-80500; Philippe Thebault, 3, rue des Capperonniers, Montdidier (FR) F-80500

( * ) Notice: Subject to any disclaimer, the term of this patent is extended or adjusted under 35 U.S.C. 154(b) by 157 days.

(21) Appl. No.: 10/587,917

(22) PCT Filed: Feb. 1, 2005

(86) PCT No.: PCT/FR2005/050061

§ 371 (c)(1),
(2), (4) Date: Aug. 2, 2006

(87) PCT Pub. No.: WO2005/075298

PCT Pub. Date: Aug. 18, 2005

(65) Prior Publication Data

US 2008/0202076 A1 Aug. 28, 2008

(30) Foreign Application Priority Data

Feb. 5, 2004 (FR) ..... 04 01104

(51) Int. Cl.
*B65B 11/00* (2006.01)

(52) U.S. Cl. ..... 53/585; 53/399; 156/86

(58) Field of Classification Search ..... 53/399, 53/585, 291, 292, 297; 156/86
See application file for complete search history.

(56) References Cited

U.S. PATENT DOCUMENTS 3,551,258 A * 12/1970 Farley et al. ..... 53/291
4,102,728 A * 7/1978 Smith ..... 53/291
4,215,460 A * 8/1980 Amberg et al. ..... 53/292
4,243,466 A * 1/1981 Lindee ..... 53/585
4,287,700 A 9/1981 Fujio
4,293,364 A 10/1981 Fujio
4,387,553 A 6/1983 Strub et al.
4,519,186 A * 5/1985 Winter et al. ..... 53/585
5,060,367 A * 10/1991 Vandevoorde ..... 53/585
6,263,940 B1 * 7/2001 Menayan ..... 53/585

FOREIGN PATENT DOCUMENTS

FR 2 646 828 A 11/1990
FR 2 808 504 A 11/2001
WO WO 97/47523 A 12/1997

* cited by examiner

*Primary Examiner*—Louis K Huynh
(74) *Attorney, Agent, or Firm*—Drinker Biddle & Reath LLP

(57) ABSTRACT

An assembly for positioning sleeves on products such as bottles. The products are conveyed in the upright position one after the other along a conveyor line and the sleeves are removed from a sleeve-feed system by transfer members above the product. The assembly comprises a single sleeve-feed system and two pairs of alternately-operating transfer members which are installed on either side of the product conveyor line. Each transfer member is supported by a carriage to travel the length of an active path along the side of the product at the sleeve-application position in order to remove a sleeve and place the sleeve on the product, in an alternating manner with the other transfer member from the pair, while the carriage of the other transfer member from the second pair moves the other transfer member from the second pair along a return path at a distance from the active path.

18 Claims, 7 Drawing Sheets

ASSEMBLE FOR POSITIONING SLEEVES ON PRODUCTS SUCH AS BOTTLES

Figure 1:
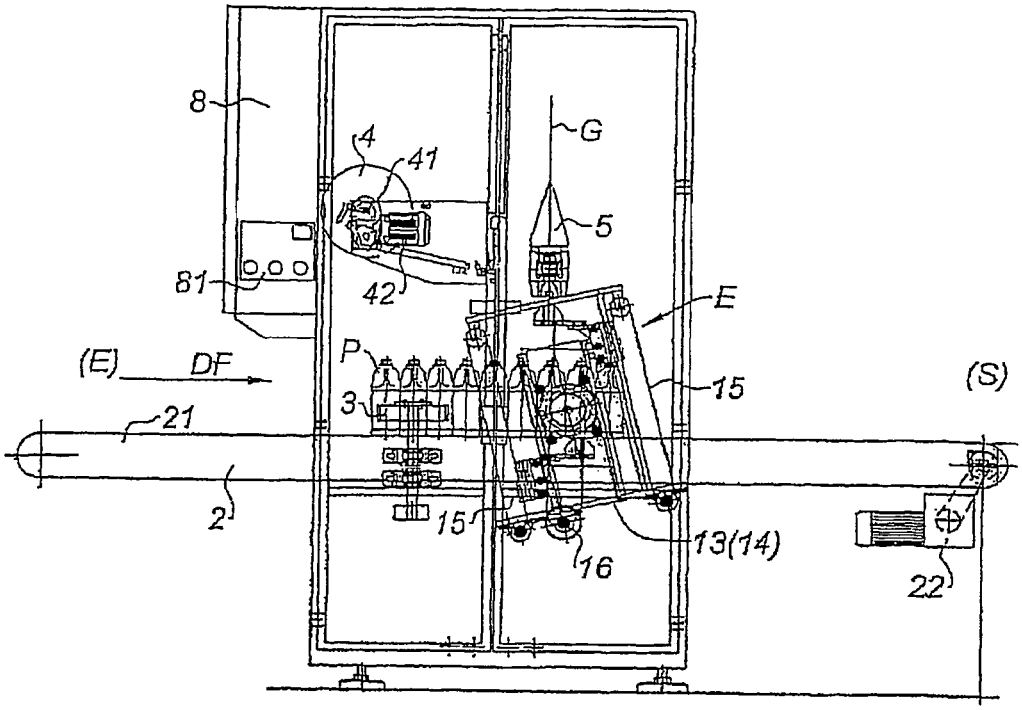

This is a 371 national stage entry of PCT/FR05/50061 filed on Feb. 1, 2005.

BACKGROUND OF THE INVENTION

The present invention relates to an installation for fitting sleeves on products such as bottles, in which the products are fed upright, one behind the other, along a conveyor line and the sleeve is drawn from a sleeve supply by transfer elements disposed above the product.

The invention relates to the field of sleeve fitting installations or sleeve fitting machines corresponding to middle-of-the-range machines, i.e. machines which operate at cycles between those of small machines operating at 25 to 40 cycles per minute and those of large machines operating at between 150 and 700 cycles per minute.

A sleeve fitting machine is effectively one element of a production line, for example a bottling line, the parameters of which and in particular the operating speeds of which are defined. Manufacturers currently make sleeve fitting machines with characteristics which are adapted to various categories of production lines, depending on the throughput rate of these lines.

This results in a multiplicity of machines because the current machines have set characteristics which do not allow them to be adapted to production lines operated at different or very different rates.

Of the machines which currently exist in the medium range, one has an inlet screw enabling the timing to be set for the products to be fitted with sleeves and a set of drawing elements which pick up the sleeves one by one and feed them onto the product as it passes the sleeve fitting station. Converting this machine in order to adapt it to handle products of different shapes is relatively complicated because of the feed screw. In addition, the output of the machine cannot be modified.

OBJECTIVE OF THE INVENTION

The objective of the present invention is to develop a sleeve fitting installation or machines of the medium range but which offer a high output, so that they can be readily adapted to fitting sleeves on products of very different shapes.

DESCRIPTION AND ADVANTAGES OF THE INVENTION

To this end, the invention relates to a sleeve fitting installation of the type outlined above, characterised by the fact that it comprises

- a single supply of sleeves drawn from a sheath, and
- two pairs of transfer elements, each comprising two transfer elements mounted on either side of the conveyor line of products and operating in alternation,
  - each transfer element being supported by a conveyor means in order to effect an active travel path along the side of the product at the sleeve fitting station, in alternation with the transfer element of the other pair, in order to pick up a sleeve and fit it on the product whilst the conveyor means of the transfer element of the other pair displaces the latter on a return path, separate from the active travel path,
- a means for synchronising the products and means for conveying the transfer elements.

Due to the two pairs of transfer elements operating in alternation, this installation is able to operate at a speed twice that of an identical machine with only one pair of transfer elements, without the double pair of transfer elements making the installation complicated or requiring it to be converted, because the two pairs of transfer elements are supplied with sleeves from a single sheath. The machine can also be very easily converted in order to adapt to a new shape of product.

This can be done simply by replacing the fitting equipment comprising the two pairs of transfer elements with their conveyor, control and synchronisation means.

The simplicity of the means used not only makes it easier to adapt rapidly to different shapes of product, but also facilitates maintenance due to the robustness of the components, their reduced number and their low inertia.

In a particularly advantageous manner, the means for synchronising the products with respect to the transfer elements is provided in the form of an inlet star, which positions the products upstream of the sleeve fitting station.

This distributor star is a particularly simple device to manufacture and replace; it efficiently positions each product in the conveyor line upstream of the sleeve fitting station. Since the products are in contact with one another on the conveyor line, they can be positioned precisely and above all very easily. Converting the installation to cater for other products to be fitted with sleeves is also very simple and is done on the basis of the distributor star by replacing it with a differently shaped star, i.e. the cells of which are adapted to the new products.

As a result of one particularly advantageous feature, the conveyor means for a transfer element comprises

- a carriage guided on a fixed track effecting an ascending and descending movement bearing the transfer element by means of an arm pivoting between a position in which it effects its active travel path and its return path by means of a control track accommodating a pulley borne by the transfer element, this track being displaced between an advanced position and a retracted position,
  - which advanced position corresponds to the active travel path of the transfer element as the carriage descends along the side of the product to be fitted with a sleeve,
  - whilst the retracted position corresponds to the return path of the transfer element as the carriage ascends towards the start of the next active travel path of the transfer element,
- a means for displacing the control track and
- a driving means for displacing the carriage along its track.

These extremely simple means enable the different movements of the transfer elements to be controlled, as well as the picking up of a sleeve and the release of a sleeve after fitting it on the product, and then return the transfer elements to the start of the active travel path.

Accordingly, due to the separate movement of each transfer element after effecting its active travel path to return to the start of the active travel path following a separate route bypassing the route followed by the other transfer element which is effecting its active travel path during this time, the transfer elements are returned to the start of their active travel path without requiring extra time. The separate return movement of each transfer element can be achieved very easily due to the fact that the transfer element is mounted on its carriage in a cantilevered arrangement and due to the fact that the carriage is guided on only one side of the fitting station, either the upstream side or the downstream side (in synchronisation with the guiding of the other transfer element of the same pair on the other side of the conveyor line).

As a result of another advantageous feature, the products are moved through the sleeve fitting station continuously and the tracks of the carriages are inclined with respect to the conveyor line as a function of the active travel path to be effected during the displacement of the product to be fitted with a sleeve, so that the difference in the horizontal displacement speeds of the pair of transfer elements on their active travel path and that of the product to be fitted with a sleeve is zero. As a result of this inclination, the installation is able to operate continuously, which is a particularly flexible solution as regards both the machine and the products, which effect a uniform movement without any braking, stopping and re-acceleration phase, as would be necessary in the case of an installation operating on a discontinuous basis, i.e. with the product stopping at the sleeve fitting station.

As a result of another advantageous feature, the drive means for a carriage is provided in the form of a direct current motor without a collector driving a belt linked to a carriage.

By virtue of another feature, the means for displacing the control track is provided in the form of a rotating cam co-operating with a pulley supported by the control track.

Control of the operation of the transfer elements is simplified in the extreme because each transfer element comprises a drawing device and a clamp for clamping the sleeve against the drawing device during the active travel path of the sleeve fitting operation, and the control track of the transfer element is split for the drawing device and the clamp, which effect substantially parallel movements during the active travel path but move towards one another at the start of the travel path to clamp the sleeve and then move apart at the end of the travel path in order to release the sleeve.

The unit comprising the tracks of the carriages and the control tracks is mounted on the installation frame. This enables replacement equipment to be prepared in advance and during operation of the installation, for example for maintenance purposes, or alternatively a set of equipment designed to cater for a different series of products. The stoppage time of the installation is therefore reduced to a strict minimum, namely the time needed to fit this unit or module, the main if not all the control systems of which are already operated externally to the installation; the process of dismantling the unit to be replaced is totally global and rapid.

Since the movement of the drawing device and that of the clamp are linked, it is advantageous if the rotating cam has two cam paths, one for controlling the movement of the control track of the drawing device and the other for the control track of the clamp.

Furthermore, since the two pairs of transfer elements are synchronised and operate in opposite phases, one very simple solution is for the rotating cam to control the movement of the two control tracks of the two transfer elements on a same side of the conveyor line.

As a result of another advantageous feature, the conveyor is of an adjustable width.

DRAWINGS

Figure 2:
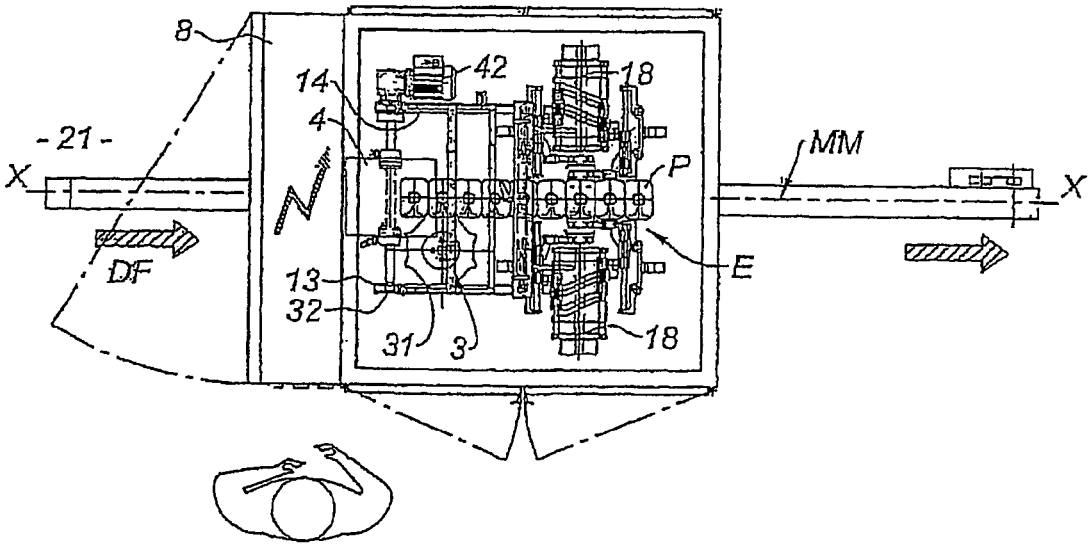
Figure 3:
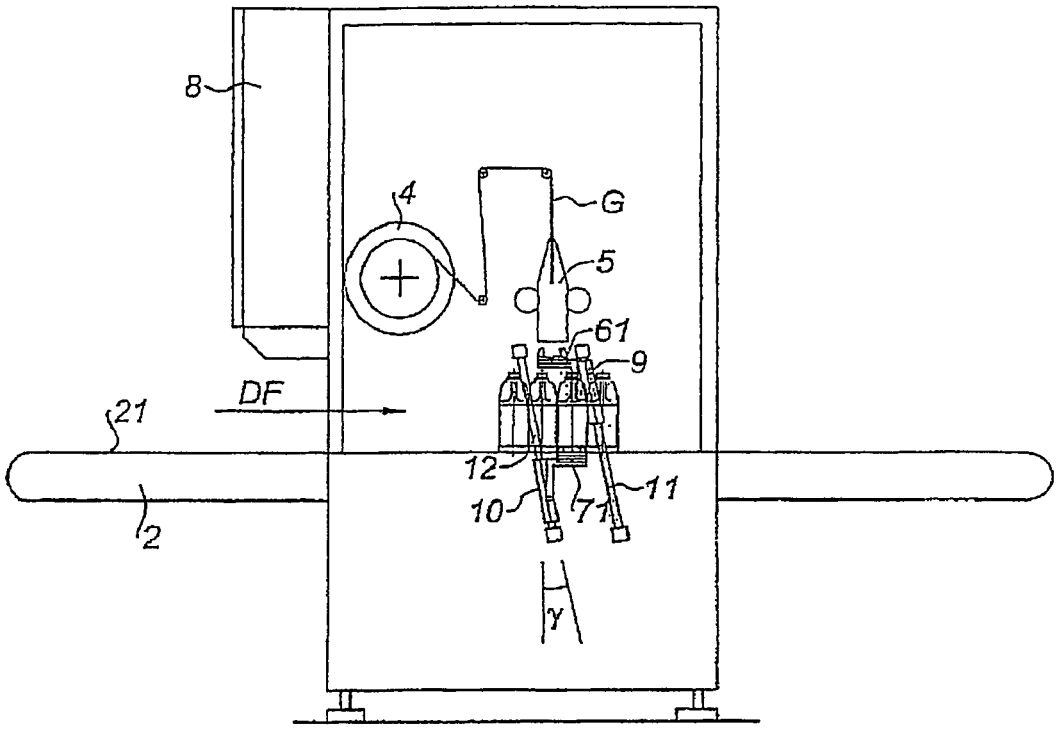
Figure 4:
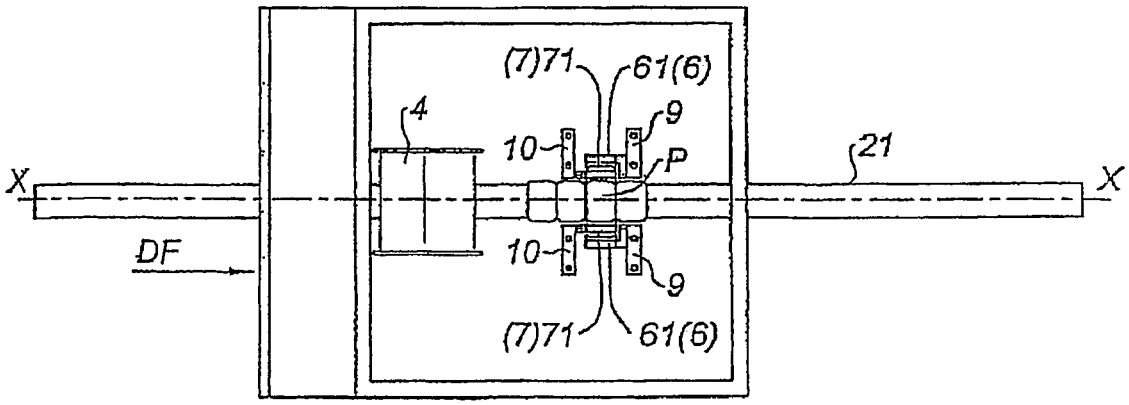
Figure 5A:
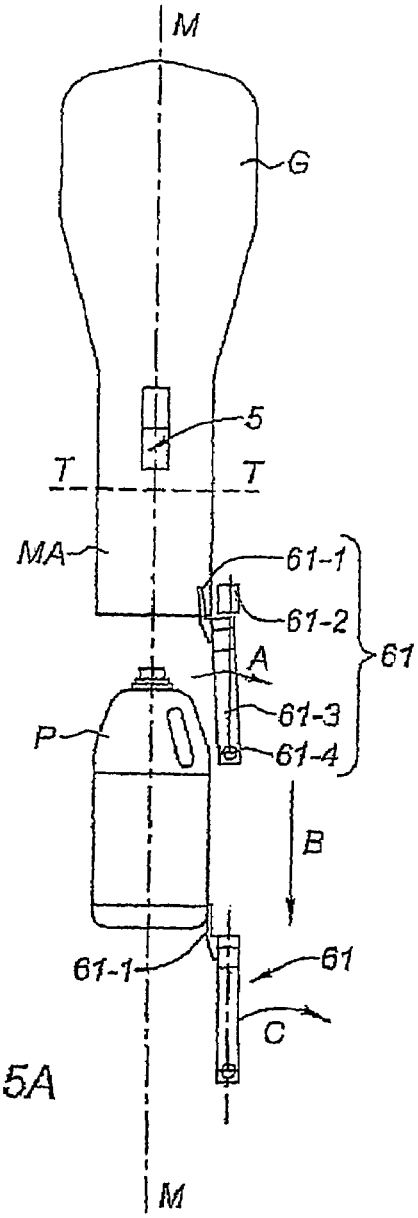
Figure 6A:
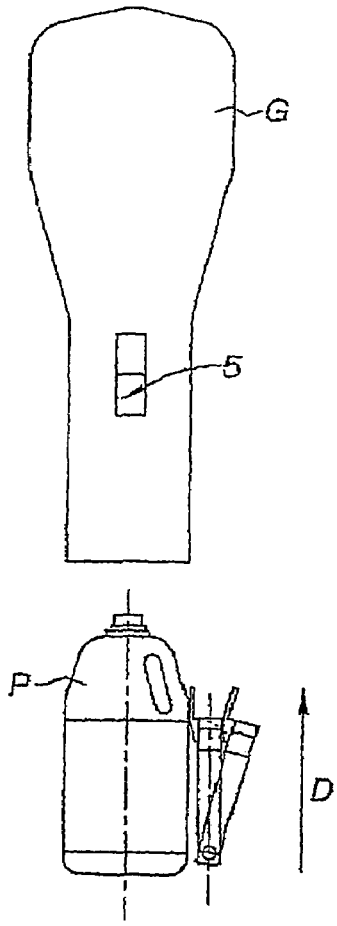
Figure 5B:
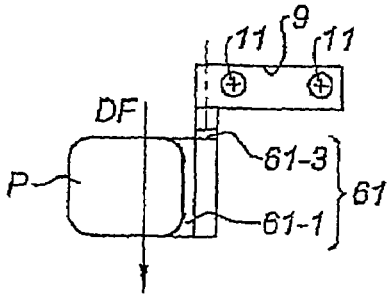
Figure 6B:
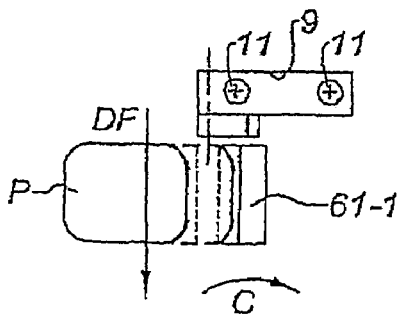
Figure 7:
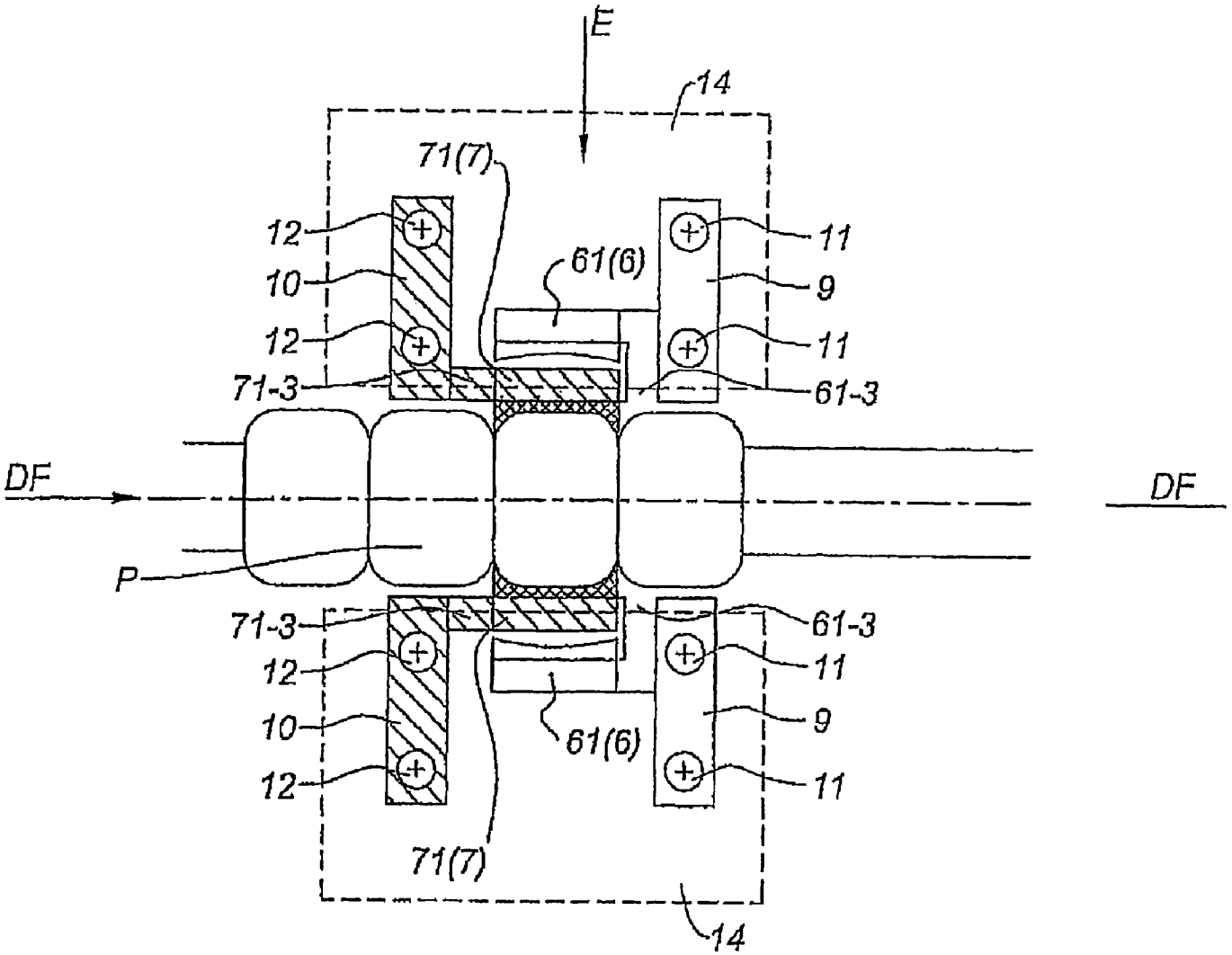
Figure 8A:
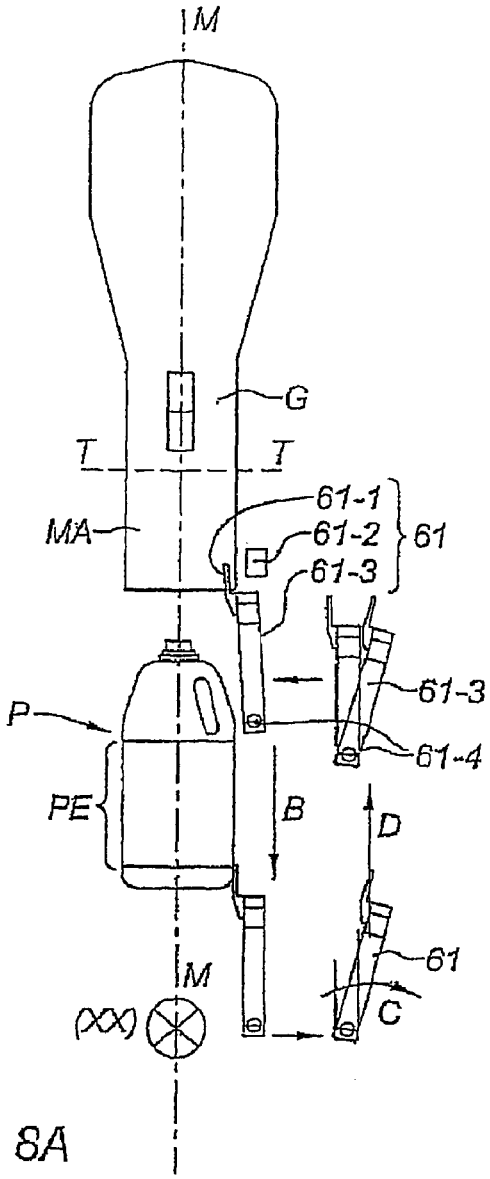
Figure 9:
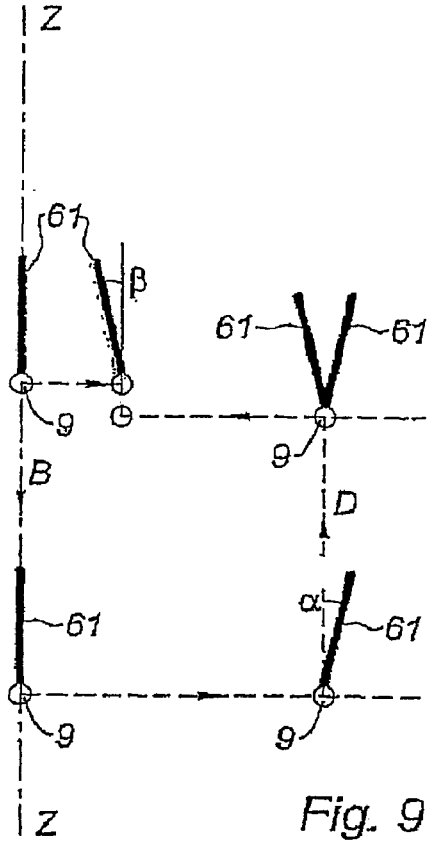
Figure 8B:
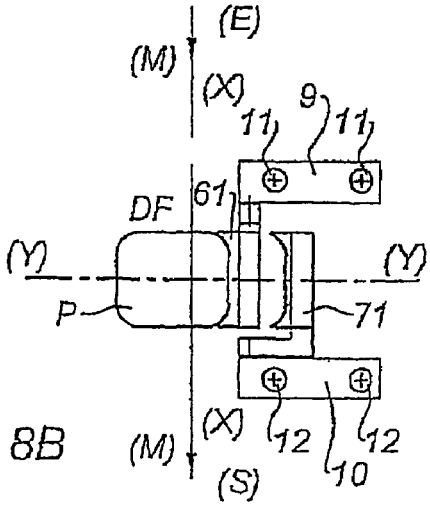
Figure 10:
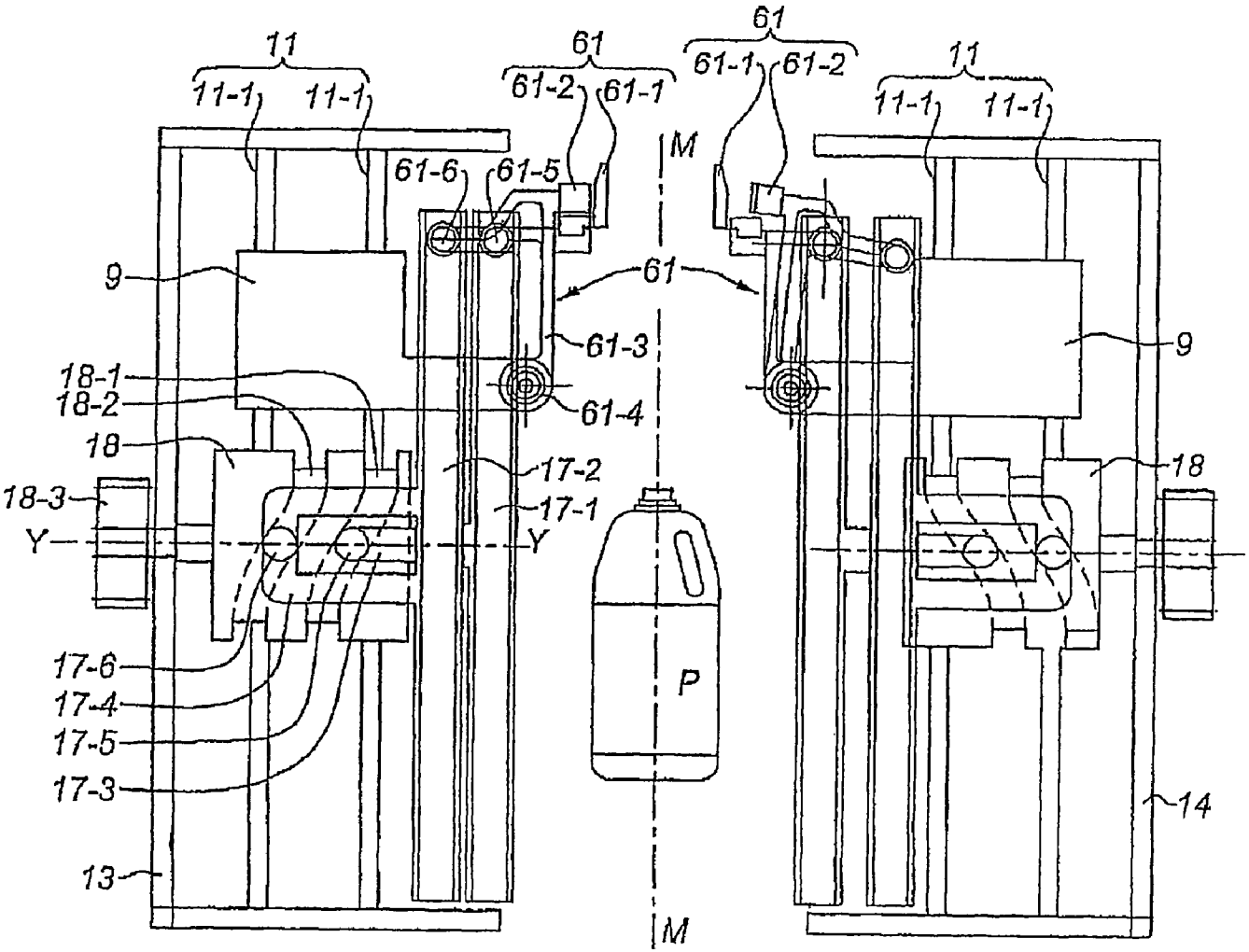
Figure 11C:
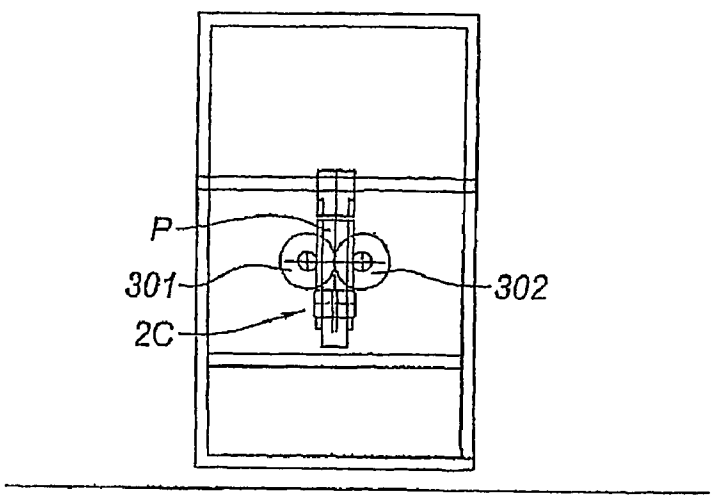
Figure 11A:
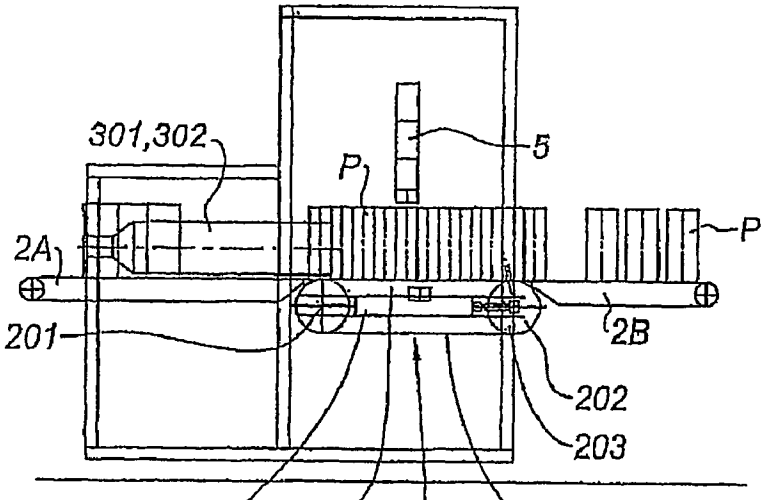
Figure 11B:
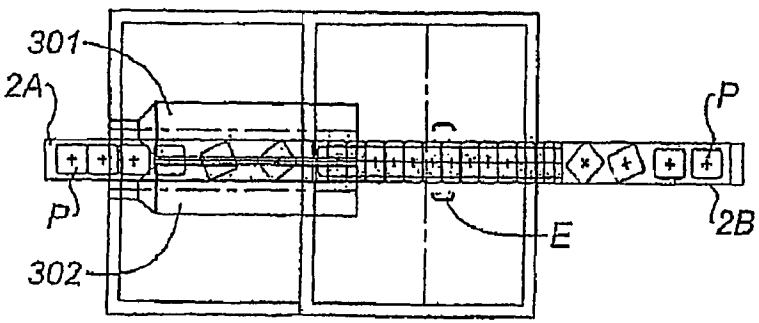

The present invention will be described in more detail below with reference to the appended drawings, in which:

FIG. 1 shows a view of a sleeve fitting installation proposed by the invention in elevation, FIG. 2 shows a plan view of the installation illustrated in FIG. 1, FIG. 3 shows a simplified view of the installation illustrated in FIG. 1 in elevation, FIG. 4 shows a simplified plan view of the installation illustrated in FIG. 1, FIG. 5A shows a schematic view of a sleeve fitting operation with the unit as viewed in the feed direction, FIG. 5B is a plan view corresponding to that illustrated in FIG. 5A, FIG. 6A is a schematic view similar to that illustrated in FIG. 5A but corresponding to the return movement of the element of the transfer element, FIG. 6B is a plan view corresponding to that illustrated in FIG. 6A, FIG. 7 is a partial view on an enlarged scale showing the sleeve fitting station illustrated in FIG. 4, FIG. 8A is a schematic view of the operating cycle of a transfer element, FIG. 8B is a plan view corresponding to that illustrated in FIG. 8A, FIG. 9 is a schematic diagram of the operating cycle of a transfer element, FIG. 10 is a partial view of the installation in the feed direction, FIGS. 11A, 11B, 11C are respective views from the side, from above and end-on of a different embodiment of the installation proposed by the invention.

DESCRIPTION OF AN EMBODIMENT OF THE INVENTION

As illustrated in FIGS. 1 and 2, the invention relates to an installation for fitting sleeves on products P such as drums, bottles, containers, flasks or cartons. The products illustrated here comprise a body with a parallelepipedic shape with a substantially rectangular section. In practice, the products P arrive back to back with one another.

These products P are fed upright, one behind the other, along a conveyor line DF along the axis xx, conveyed by an endless conveyor 2 linking the inlet E to the outlet S. They are synchronised by means of a distributor star 3, the contour of which is provided with cells 31 matching the shape of the respective side of the product P so that only one product at a time is picked up as the ends or tips 32 of the cells 31 move in the gap between the edges of two successive products P. The products are therefore positioned in a precise and synchronised manner as they pass the sleeve fitting station E disposed slightly downstream of the distributor star 3. This precise positioning is necessary because upstream, the products P are conveyed randomly by the conveyor belt 21 of the conveyor 2 driven by a speed-reducing motor 22.

In certain instances, because the products P may be of very variable dimensions, it is necessary for the operation of the installation, as will become apparent later, to ensure that the conveyor is not wider than the products to be fitted with sleeves on a level with the sleeve fitting station. For this reason and depending on the application for which the installation is designed, if it is designed for a single product, there will preferably be only a single conveyor between the inlet and the outlet of the installation.

In the case of an installation designed to process products of different sizes, it is of interest to replace the single conveyor with an inlet conveyor of maximum width, an intermediate conveyor on a level with the sleeve fitting station with a width which can be adjusted depending on the processed products, and a conveyor of maximum width at the outlet. This solution proposed by the invention enables the products to be conveyed in the most stable manner, i.e. affording as wide as possible a support for the products, even and especially during the sleeve fitting operation.

The sleeve fitting equipment is provided in the form of a sleeve supply unit and a sleeve fitting unit.

The sleeve supply equipment comprises a reel 4 of pre-printed sheath, with a print layout conforming to the future sleeves. This reel 4 is supported by a shaft 41 driven by a speed-reducing motor 42 regulating the feed rate of the sheath G; the latter arrives above the sleeve fitting station E. Having been removed from the reel 4, the sheath G passes onto a guide system 5 which opens the sheath G and enables a length of sleeve MA to be cut.

The fitting equipment is globally symmetrical relative to a median plane MM of the installation or more specifically relative to a vertical plane intersecting the axis xx, i.e. the conveyor line DF of products P at the sleeve fitting station E. Consequently, the equipment is made up of two units of fitting means, disposed symmetrically with respect to this median plane and operating on a fully synchronised basis.

These units are mainly two pairs of transfer elements 6, 7, each formed by a transfer element 61, 71 disposed on either side of the conveyor line DF of the products P and at the side of them so that they intervene only laterally with respect to the products and do not move between two successive products P.

The transfer elements 61, 71 are driven by conveyor means, controlled by a control and synchronisation means so that they operate in alternation, one of the pairs effecting its active travel path fitting a sleeve whilst the other is effecting its return path.

During the active travel path, a sleeve MA is picked up each time by the two transfer elements 61, 71 of a pair 6, 7, which clamp it and open it whilst drawing it in order to lower it and move it above the product to be fitted with a sleeve. The forward feed of the sheath in order to pick up the sleeves MA is controlled step by step by the transfer elements 61, 71, which pull on the sheath G. The movement of the sheath G, fed forward by the speed reducing motor 42, is regulated on the basis of the average pick-up speed in order to compensate for the discontinuous picking up of the sleeves one by one, due to an extra length of slack sheath upstream of the guide system 5. Since the transfer elements 61, 71 which pick up the sleeves and place them on each product P are disposed at the sides of the conveyor line DF of products, only the tensed sleeve MA moves into the gap between two products P positioned and conveyed by the star conveyor 3 upstream and which are practically touching due to the very slim thickness of the sleeve.

The installation also has an electric cabinet 8 with controls 81, although a detailed description of these will not be given. The electrical equipment controls and regulates operation of the different motors or speed reducing motors for driving the conveyor 2, the distributor star 3, unreeling of the sheath G from the reel 4 and the movement of the transfer elements 61, 71, using signals supplied by sensors, in particular position and end of travel sensors, although these are not illustrated.

The sleeve fitting equipment made up of two symmetrical units and disposed on either side of the conveyor line DF of products schematically illustrated in FIGS. 1 and 2 will be described in more detail with reference to FIGS. 3-8.

FIGS. 3 and 4 merely give a simplified illustration of the main means of the invention for fitting a sleeve and FIGS. 5A-9 illustrate how the installation operates.

Due to the symmetry of the structure and operation of the fitting equipment straddling the conveyor line of the products and made up of two units disposed on either side of this line, the description will be limited to one of these units. It comprises two transfer elements 61, 71 belonging to one of the two pairs 6, 7 of transfer elements.

A transfer element, for example transfer element 61, is made up of (see FIGS. 3 and 10) a drawing device 61-1, which is a spoon-shaped piece, and a clamp 61-2. The drawing device is introduced inside the sleeve and the clamp is applied externally against the sleeve to clamp it on the drawing device. Each transfer element 61, 71 is borne by a carriage 9, 10 sliding on a track 11, 12 formed by two columns 11-1 or 12-1.

The transfer element 61, 71 is substantially horizontal and its movement relative to the product is a relative vertical movement during the operation of positioning the sleeve but the track is inclined in order to compensate for the horizontal movement of the product during the sleeve fitting operation. In practice, since the installation operates on a continuous basis, the product does not stop during fitting of the sleeve but is fed at a constant speed. Under these conditions, the inclination of the downward path of the carriage 9, 10 with its track 11, 12 is such that this downward path corresponds in terms of horizontal projection to the distance travelled by a product during a sleeve fitting operation between the arrival of the transfer element 61, 71 bearing the sleeve MA above the product P and the start of engagement of the sleeve from above the product until the instant at which the transfer element 61, 71 disengages from the sleeve. In other words, the inclination of the downward path of the transfer element 61, 71 compensates for the forward movement of the product P so that the difference in horizontal speed between the transfer element and the product is zero during a sleeve fitting operation. This downward path corresponds to the active travel path of the transfer element.

The inclination of the track 11, 12 can be adjusted depending on the characteristics of the product to be fitted with a sleeve, i.e. primarily its height.

The plan view given in FIG. 4 shows the two pairs 6, 7 of transfer elements 61, 71, each comprising a transfer element 61, 71 to the right and an element to the left of the feed path DF of the products. The two transfer elements 61 or 71 of a same pair 6 or 7 operate in synchronisation, as do the two pairs 6, 7 themselves. They both engage in the sleeve at the same time in order to clamp it and pull it over the product, and are then disengaged, moving into a retracted position before ascending on the return path to return to the start of the active travel path.

For the return movement, the transfer elements 61 or 71 of this pair 6 or 7 move sufficiently far apart on the side in the transverse direction relative to the feed direction DF to leave enough space with respect to the product P for the other transfer element 61 or 71 of the other pair 6 or 7 to pass on its active travel path for fitting a sleeve on the next product.

The operation of the installation and the movement of a transfer element 61, 71 are illustrated by the diagrams given in FIGS. 5A-6B, viewed in the feed direction of the products P, i.e. the direction perpendicular to the direction of FIG. 3 in the case of FIGS. 5A, 6A and the direction of FIG. 4 in the case of FIGS. 5B, 6B; the illustration and description are limited to one transfer element of a single pair during the different stages of operation.

FIG. 5A illustrates the arrival of the sheath G on the guide system 5, which opens it and enables the drawing device 61-1 of the transfer element 6 to pass inside the opening of the sheath G. The transfer element 61 in the upper position is at the start of its active travel path. Its drawing device 61-1 has penetrated the part of the sheath forming the sleeve MA, which will be clamped by the clamp 61-2.

The sleeve MA is then cut from the sheath G as indicated by broken lines TT. The transfer element 61 borne by an arm 61-3 linked to the horizontal shaft 61-4 of the carriage swings lightly in a clockwise direction (arrow A) in order to draw the sleeve MA transversely. The transfer element 61 carrying the sleeve then descends along the side of the product as far as a bottom position (arrow B). This bottom position corresponds to the end of the sleeve MA fitting operation because the drawing device 61-1 has just been released from the sleeve.

The plan view illustrated in FIG. 5B illustrates how the drawing device 61-1 follows the contour of the product P and places the sleeve over the product.

After the drawing device 61-1 has been released from the fitted sleeve at the end of the active travel path illustrated in FIG. 5A, the transfer element 61 which, at the end of the sleeve fitting operation was moved towards the product P by a swinging action in the direction opposite to arrow A to release the sleeve MA, now moves back towards the exterior; it swings in the direction of arrow C to a relatively pronounced degree in order to move away from the product P by a distance essentially corresponding to the thickness of a transfer element. The released transfer element 61 then ascends again (arrow D) to return to the start of its new active travel path (FIG. 6A) via its return path (arrow D).

The plan view illustrated in FIG. 6B shows the swung-out position of the transfer element 61 and the dotted lines show its sleeve fitting position. As a result of this swinging movement (arrow C), the transfer element 61 can easily pass behind the other transfer element in the process of fitting a sleeve during its return path (arrows).

It should be noted that on either side of the plane of symmetry MM of FIG. 5A, 6A or 5B, 6B, there is a symmetrical transfer element of the same pair, operating in the same manner and in synchronisation with it.

The alternating operation of the two pairs of transfer elements proposed by the invention can be easily achieved by mounting them in a cantilevered arrangement on a single track.

FIG. 7, which is an enlarged diagram of the sleeve fitting station E showing the plan view of FIG. 4, illustrates the relative disposition of the transfer elements 61, 71 of the two pairs 6, 7. To make them easier to distinguish, one of the pairs 7, that in the active position, is illustrated with hatching by convention.

The tracks 11, 12 co-operating with the two pairs 6, 7 of transfer elements 61, 71 are supported by a frame 13, 14 in one or two parts (FIGS. 1 and 2), fitted with drive means for controlling the movement of the transfer elements as well as their opening and closing movements. In this embodiment, each transfer element is linked to its carriage by a pivot, enabling it to be transferred into an active position on the active travel path close to the corresponding side of the product to be fitted with a sleeve and into a released position corresponding to the return path at a distance apart from the side of the product. This swinging motion is controlled by a cam, using a mechanism that will be described with reference to FIG. 10.

The transfer elements and the co-operating carriages are moved, apart from the inclination, in the direction perpendicular to the plane of FIG. 10. The cantilevered mounting of the transfer elements 61, 71 by means of their arms 61-3, 71-3 and the fact that they each cooperate with a carriage 9, 10 positioned on one side permits the alternating operation (or phase opposition) of the two pairs of transfer elements.

For the active travel path, the two transfer elements 71 of this pair 7 (this numbering is conventional) are moved towards the product P during the sleeve fitting operation, whereas the two transfer elements 61 of the other pair 6 are swung towards the exterior to ascend along their return path beyond the trajectory needed for the transfer elements 71 of the first pair 7 to pass.

This FIG. 7 illustrates the fact that the alternating movement of the pairs 6, 7 of transfer elements is possible not just due to the cantilevered mounting of the transfer elements 61, 71 on their respective carriage 9, 10. In this embodiment, the carriages 10 of a pair 7 are disposed upstream of the fitting station E and those 9 of the other pair 6 downstream, because this symmetrical disposition is simple.

However, it would also be possible to offset the carriages of a pair, one upstream and the other downstream, in the pattern of a X.

This plan view also illustrates how the guide tracks 11, 12 of the carriages 9, 10 are fixed (with the exception of their inclination, which is not illustrated). These tracks are provided in the form of two columns in this instance.

In order to keep the illustration simple, neither FIG. 7 nor FIGS. 5A-6B illustrate the means for controlling the swinging motion of the transfer elements on their active travel path or their return path.

FIG. 8A shows various positions of a transfer element, for example the element 61, in order to illustrate a motion cycle.

Having penetrated the sheath G, the drawing device 62-1 swings slightly towards the exterior (in a clockwise direction) to draw the sleeve MA and then pull it above the product P, allowing it to retract, until the position PE provided for the sleeve. This position PE is indicated on this product P by a slightly hollowed annular zone.

During the positioning movement, the clamp 61-2 holds the bottom edge of the sleeve against the drawing device 61-1.

At the end of fitting, the clamp releases the sleeve, which enables the clamp to move away from the sleeve by sliding and continuing its downward movement.

The transfer element 61 then swings towards the side in a clockwise direction to embark on the return path D and ascend without encountering the transfer element 71, not illustrated, of the other pair 7, which during this time is fitting its sleeve on the following product.

At the end of the return path, the transfer element swings in the opposite direction, anti-clockwise, so that it can rise inside the sheath G and pick up a new sleeve. Consequently, each pair 6, 7 of transfer elements fits a sleeve on a product in alternation with the other pair.

As already emphasised above and by contrast with the travel paths schematically illustrated in this drawing, the carriage 9 of the transfer element 61 travels the same path defined by its guide track during its active travel path and its return path, the two paths being illustrated separately merely with a view to simplifying the description of the movement.

This may also be seen in the plan view of FIG. 8B, which shows how the carriages 9, 10 remain fixed in vertical projection (leaving aside the inclination of the tracks in the feed direction of the products).

FIG. 9 provides a schematic illustration of the motion cycle of a transfer element 61, based on the same convention as the diagram of FIG. 8A, whereas in reality the movement of the carriage 9 is effected along the axis ZZ.

The swinging motion to move the transfer element aside towards the return position is indicated by an angle $\alpha$ and the swinging motion before the drawing device penetrates the sheath is indicated by angle $\beta$.

FIG. 10 illustrates how the cam controls the swinging movement of the transfer elements 61. The frame formed by two identical (symmetrical) parts 13, 14 for ease of fitting, one on the left and the other on the right of the feed path DF supports the two columns 11-1, 12-1 of each track 11, 12 and the carriage 9, 10; the latter is coupled with a toothed driving belt 15 which circulates on a drive motor 16 (these details are illustrated in FIG. 1).

The transfer element 61 is supported essentially vertically by its arm 61-3, mounted so that it can pivot about the horizontal axis 61-4 on the frame 13 or 14. The arm 61-3 directly supports the drawing device 61-1 fitted with a pulley 61-5 circulating in a control track 17-1; it also supports the clamp 61-2 but so that it can move, which is likewise provided with a pulley 61-6 circulating in another control track 17-2.

Each of the two control tracks 17-1, 17-2, parallel with the track 11 of the carriage 9, is able to move in translation in the transverse direction yy. To this end, the movement is controlled by a lug 17-3, 17-4 co-operating with each control track 17-1, 17-2 and fitted with a cam pulley 17-5, 17-6 guided by two paths 18-1, 18-2 of the cam 18. The rotating cam 18 is driven in rotation by a speed reducing motor 18-3 synchronised with the operation of the fitting equipment.

The translating movement of the two control tracks 17-1, 17-2 firstly enables the clamp 61-2 to be closed and opened by modifying the spacing of the two control rails 17-1, 17-2 and secondly enables the transfer element 61 to swing, globally speaking, either in the active travel path for fitting purposes or in the return path.

FIG. 10 illustrates one 6 of the two pairs 6, 7 of transfer elements 61, 71, the other pair 7 being disposed in front or behind the plane of FIG. 10. This other pair can be controlled by the same rotating cam 18 and its movement, given that it is in the opposite phase from that of the first pair, may be imparted by the same motor as that driving the first pair with a shaft bearing a pulley meshing in a toothed belt similar to that of the first pair.

The movements of the two parts of the fitting equipment are synchronised electronically in the control cabinet.

To summarise, each pair of transfer elements effects a movement comprising the following phases:

Engaging in the sheath in order to clamp a sleeve.

After severing the sleeve, moving the transfer element aside and moving above the product. The sleeve is applied against the product by elastic return. At the end of the fitting travel path, the clamp of the sleeve is opened and the transfer element is disengaged. The transfer element then leaves from below the product being processed or at least by the downward travel path necessary to disengage it from the sleeve.

The transfer element swings into a disengaged position.

The carriage bearing the transfer element then ascends until it reaches the active position.

FIGS. 11A, 11B, 11C illustrate a different embodiment of the installation proposed by the invention. The description below relates only to those parts which are different from the embodiment described above and no explanation will be given of parts that are identical.

This installation is made up of an inlet conveyor 2A of a fixed speed and an outlet conveyor 2B likewise of a fixed speed. Disposed between these two conveyors is a central conveyor 2C with a variable speed. This central conveyor 2C comprises a frame 200 supporting an inlet wheel 201 and an outlet wheel 202. The latter is linked to the frame 200 via a rapid tensioning device 203, not illustrated in detail, to permit a rapid change of belt. The belt 204 circulates on the inlet wheel 201 and the outlet wheel 202. In fact, the wheels are cylinders or discs of a width which can be adjusted depending on the width of the belt 204 used.

The motor for driving the inlet wheel 201 is not illustrated.

The top strand of the belt 204 on which the products P are supported is supported by a supporting belt 205, the width of which is variable. This supporting belt is mounted in the frame by rapid linking means. Likewise, the belt 204 is interchangeable and can be replaced by a belt of a different width. In order to make this change, it is of interest to be able to release the tension exerted on the belt rapidly by acting on the outlet wheel or outlet cylinder 202 to retract it, enabling the belt to be changed and then placed under tension again.

This installation does not have an inlet star but two inlet screws 301, 302, installed on either side of the feed path of the products P above the inlet conveyor 2A. These inlet screws 201, 202 rotate at a slightly different speed, enabling the orientation of the products to be changed between their position at the inlet and their position on the intermediate conveyor 2C for the sleeve fitting operation and then again at the outlet.

The other elements of the installation, and in particular those used for fitting the sleeve, are not illustrated or are only schematically indicated. These means are the same as those described above.

The invention claimed is:

1. Installation for fitting sleeves on products such as bottles, in which the products are fed upright, one behind the other, along a conveyor line and the sleeve is drawn from a sleeve supply by means of transfer elements from above the product, comprising a single supply of sleeves drawn from a sheath, two pairs of transfer elements, each comprising two transfer elements mounted on either side of the conveyor line of products and operating in alternation, each transfer element being supported by a carriage of a conveyor means conveying the transfer elements in order to effect a straight active travel path along the side of the product at the sleeve fitting station, in alternation with the transfer element of the other pair, in order to pick up a sleeve and fit it on the product whilst the conveyor means of the transfer element of the other pair displaces the latter on a return path, separate from the active travel path, and a means for synchronising the products and the carriage, wherein the carriage is guided on a fixed track and bears the transfer element by means of an arm pivoting between a position in which it effects its active travel path and its return path by means of a control track accommodating a pulley borne by the transfer element, this track being displaced between an advanced position and a retracted position, which advanced position corresponds to the active travel path of the transfer element as the carriage descends along the side of the product to be fitted with a sleeve, whilst the retracted position corresponds to the return path of the transfer element as the carriage ascends towards the start of the next active travel path of the transfer element, a means for displacing the control track, and a driving means for displacing the carriage along its track.

2. Installation as claimed in claim 1, further comprising a means for synchronising the products with respect to the transfer elements is provided in the form of an inlet star which positions the products upstream of the sleeve fitting station.

3. Installation as claimed in claim 1, wherein the movement of the products through the sleeve fitting station is continuous and the tracks of the carriages are inclined with respect to the conveyor line as a function of the active travel path to be effected during the displacement of the product to be fitted with a sleeve, so that the difference in the horizontal displacement speeds of the pair of transfer elements on their active travel path and that of the product to be fitted with a sleeve is zero.

4. Installation as claimed in claim 1, wherein the drive means for a carriage is provided in the form of a direct current motor without a collector driving a belt linked to a carriage.

5. Installation as claimed in claim 1, wherein the means for displacing the control track is provided in the form of a rotating cam co-operating with a pulley supported by the control track.

6. Installation as claimed in claim 1, wherein each transfer element comprises a drawing device and a clamp for clamping the sleeve against the drawing device during the active travel path of the sleeve fitting operation, and the control track of the transfer element is split for the drawing device and the clamp, which effect parallel movements during the active travel path but move towards one another at the start of the travel path to clamp the sleeve and then move apart at the end of the travel path in order to release the sleeve.

7. Installation as claimed in claim 6, comprising a unit pivotably mounted on a frame of the installation and comprising the fixed tracks on which the carriages are guided and the control tracks.

8. Installation as claimed in claim 6, wherein the rotating cam has two cam paths, one for controlling the movement of the control track of the drawing device and the other for the control track of the clamp.

9. Installation as claimed in claim 8, wherein the rotating cam controls the movement of the two control tracks of the two transfer elements on a same side of the conveyor line.

10. Installation for fitting sleeves on products such as bottles, in which the products are fed, one behind the other, along a conveyor line and the sleeve is drawn from a sleeve supply by transfer elements from above the product, comprising:

a single supply of sleeves drawn from a sheath;

two pairs of transfer elements, each pair comprising two transfer elements mounted on either side of the conveyor line of products and operating in alternation, each transfer element being supported by a conveyor effecting an ascending and descending movement in order to effect a straight active travel path along the side of the product at a sleeve fitting station, in alternation with the transfer element of the other pair, to pick up a sleeve and fit it on the product whilst the conveyor of the transfer element of the other pair displaces the latter on a return path, separate from the active travel path;

a synchronizer for the products and the conveyer for the transfer elements;

wherein the conveyor for a transfer element comprises a carriage guided on a fixed track effecting the ascending and descending movement bearing the transfer element by an arm pivoting between a position in which it effects its active travel path and its return path by a control track accommodating a pulley borne by the transfer element, this track being displaced between an advanced position and a retracted position;

wherein the advanced position corresponds to the active travel path of the transfer element as the carriage descends along the side of the product to be fitted with a sleeve, whilst the retracted position corresponds to the return path of the transfer element as the carriage ascends towards the start of the next active travel path of the transfer element;

a displacer for the control track; and a driver for displacing the carriage along its track.

11. Installation as claimed in claim 10, further comprising a synchronizer for the products with respect to the transfer elements comprising an inlet star that positions the products upstream of the sleeve fitting station.

12. Installation as claimed in claim 10, wherein in normal operation the movement of the products through the sleeve fitting station is continuous and the tracks of the carriages are inclined with respect to the conveyor line as a function of the active travel path to be effected during the displacement of the product to be fitted with a sleeve, so that the difference in the horizontal displacement speeds of the pair of transfer elements on their active travel path and that of the product to be fitted with a sleeve is zero.

13. Installation as claimed in claim 10, wherein the driver for a carriage comprises a brushless direct current motor driving a belt linked to a carriage.

14. Installation as claimed in claim 10, wherein the displacer for the control track comprises a rotating cam co-operating with a pulley supported by the control track.

15. Installation as claimed in claim 14, wherein each transfer element comprises a drawing device and a clamp, and the rotating cam has two cam paths, one for controlling the movement of the control track of the drawing device and the other for the control track of the clamp.

16. Installation as claimed in claim 15, wherein the rotating cam controls the movement of the two control tracks of the two transfer elements on a same side of the conveyor line.

17. Installation as claimed in claim 10, wherein each transfer element comprises a drawing device and a clamp for clamping the sleeve against the drawing device during the active travel path of the sleeve fitting operation, and the control track of the transfer element is split for the drawing device and the clamp, which move towards one another at the start of the travel path to clamp the sleeve, effect parallel movements during the active travel path, and then move apart at the end of the travel path in order to release the sleeve.

18. Installation as claimed in claim 10, wherein the tracks of the carriages and the control tracks are pivotably mounted as a unit on a frame of the installation.

* * * * *